US008152661B2

(12) United States Patent
House

(10) Patent No.: US 8,152,661 B2
(45) Date of Patent: Apr. 10, 2012

(54) LACROSSE TRAINING METHOD AND APPARATUS

(76) Inventor: Richard G. House, Chevy Chase, MD (US)

( * ) Notice: Subject to any disclaimer, the term of this patent is extended or adjusted under 35 U.S.C. 154(b) by 0 days.

(21) Appl. No.: 12/696,440

(22) Filed: Jan. 29, 2010

(65) Prior Publication Data

US 2010/0190586 A1 Jul. 29, 2010

Related U.S. Application Data

(60) Provisional application No. 61/148,066, filed on Jan. 29, 2009.

(51) Int. Cl.
*A63B 59/02* (2006.01)
*A63B 65/12* (2006.01)

(52) U.S. Cl. ..... 473/513; 473/220; 473/446

(58) Field of Classification Search ..... 473/513, 473/512, 505, 220, 457, 409; D21/724
See application file for complete search history.

(56) References Cited

U.S. PATENT DOCUMENTS

| | | | | | |
|---|---|---|---|---|---|
| 3,953,034 | A | * | 4/1976 | Nelson | 473/220 |
| 4,693,479 | A | * | 9/1987 | McGwire | 473/220 |
| 5,146,463 | A | | 9/1992 | Rando | |
| 5,161,802 | A | | 11/1992 | Daechsel | |
| 5,371,347 | A | | 12/1994 | Plesko | |
| 5,465,972 | A | | 11/1995 | Cornett | |
| 5,467,991 | A | * | 11/1995 | White et al. | 473/220 |
| 5,544,888 | A | * | 8/1996 | Pellegrini | 473/220 |
| 5,593,354 | A | | 1/1997 | Falossi | |
| 5,607,226 | A | | 3/1997 | Toth | |
| 5,655,973 | A | * | 8/1997 | McPherson, Jr. | 473/220 |
| 5,692,965 | A | * | 12/1997 | Nighan et al. | 473/220 |
| 5,725,440 | A | * | 3/1998 | Finney | 473/220 |
| 5,733,202 | A | * | 3/1998 | Vargo | 473/220 |
| 5,759,110 | A | * | 6/1998 | Seibel et al. | 473/220 |
| 5,788,582 | A | * | 8/1998 | Shapiro | 473/220 |
| 5,788,588 | A | * | 8/1998 | Hooker | 473/409 |
| 5,993,333 | A | | 11/1999 | Heckaman | |
| 6,149,531 | A | * | 11/2000 | Hooker | 473/220 |
| 6,746,336 | B1 | | 6/2004 | Brant | |
| 6,770,002 | B2 | | 8/2004 | Aigotti | |
| 7,009,141 | B1 | | 3/2006 | Wool et al. | |
| 7,326,132 | B2 | | 2/2008 | Olexa | |
| 2001/0027136 | A1 | | 10/2001 | Chris | |
| 2006/0058122 | A1 | | 3/2006 | Cox | |

(Continued)

FOREIGN PATENT DOCUMENTS

JP 2009112613 A2 5/2009

(Continued)

*Primary Examiner* — Gene Kim
*Assistant Examiner* — Michael Chambers
(74) *Attorney, Agent, or Firm* — Edell, Shapiro & Finnan, LLC

(57) ABSTRACT

A training device for teaching proper mechanics of aiming and propelling a lacrosse ball is disclosed. The training device is a lacrosse stick including a shaft portion, a head portion, and an end cap. The end cap includes a light source that generates a beam of visible light capable of forming a visible light point on a surface remote from the user. In operation, a user orients a lacrosse stick in a starting position to align the eye of the stick with a target. The user directs the light point generated by the light source onto the target, and then moves the lacrosse stick in a motion sufficient to propel the lacrosse ball from the head portion toward the target.

16 Claims, 10 Drawing Sheets

U.S. PATENT DOCUMENTS

| | | | | |
|---|---|---|---|---|
| 2006/0154752 | A1 | 7/2006 | Hutton | |
| 2006/0154755 | A1 | 7/2006 | Velasquez | |
| 2007/0105664 | A1 | 5/2007 | Scheinert et al. | |
| 2007/0153532 | A1 | 7/2007 | Milligan et al. | |
| 2007/0184923 | A1* | 8/2007 | Morrow | 473/513 |
| 2008/0032829 | A1 | 2/2008 | Andrea et al. | |
| 2008/0248899 | A1 | 10/2008 | Whitten et al. | |
| 2009/0197711 | A1 | 8/2009 | Sommers et al. | |
| 2009/0239687 | A1 | 9/2009 | Purnell | |
| 2010/0190586 | A1* | 7/2010 | House | 473/446 |

FOREIGN PATENT DOCUMENTS

| | | |
|---|---|---|
| WO | 9324183 | 12/1993 |
| WO | 9324189 | 12/1993 |

* cited by examiner

LACROSSE TRAINING METHOD AND APPARATUS

CROSS REFERENCE TO RELATED APPLICATIONS

This application claims priority to provisional patent application No. 61/148,066, entitled Improved Lacrosse Training Method and Apparatus and filed on 29 Jan. 2009. The disclosure of the aforementioned provisional application is hereby incorporated by reference in its entirety.

FIELD OF THE INVENTION

The present invention relates to training methods for projecting objects and, in particular, a lacrosse training stick including a laser generator and a method of using the lacrosse stick to teach and practice lacrosse stick movements.

BACKGROUND OF THE INVENTION

Lacrosse in an increasingly popular sport with a growing number of participants. The sport is played on a field where a hard rubber ball is passed from player to player and thrown towards a goal to score. The ball is handled with sticks including a shaft and a head. During the passing, throwing, and shooting of the ball, the lacrosse stick is typically actuated through an arc such that the head of the stick undergoes a significant rotational acceleration. A player drives or pushes the butt-end of the stick, with the bottom hand towards the target, while at the same time pulling down on the bottom of the handle in order to shoot on goal.

The effectiveness of the throw is often dependent on the throwing technique or form that is used. Players often struggle to attain a proper technique when using a lacrosse stick to throw a ball, especially novice players and athletes attempting to throw with their non-natural hand (i.e., a righty throwing left-handed and a lefty throwing right-handed). Typical throwing errors are often related to improper motion of the head of the lacrosse stick. One error occurs when the plane of the head is not oriented properly to the direction of the desired throw. Another error occurs when the timing of the shot initiation is improper.

Accordingly, it would be desirable to provide a lacrosse training apparatus and method that trains a user to utilize a correct throwing technique.

SUMMARY OF THE INVENTION

A training device for teaching proper mechanics of aiming and propelling a lacrosse ball is disclosed. The training device is a lacrosse stick including a shaft portion, a head portion, and an end cap. The head portion is configured to receive and support a lacrosse ball. The end cap includes a light source that generates a beam of visible light capable of forming a visible light point on a surface remote from the user. In operation, a user orients a lacrosse stick in a starting position to align the eye of the stick with a target. The user directs the light point generated by the light source onto the target, and then moves the lacrosse stick in a motion sufficient to propel the lacrosse ball supported by the head portion toward the target. In another embodiment, the light source is integrated into a lacrosse glove.

BRIEF DESCRIPTION OF THE DRAWINGS

Like reference numerals have been used to identify like elements throughout this disclosure.

DETAILED DESCRIPTION OF THE INVENTION

Figure 1:
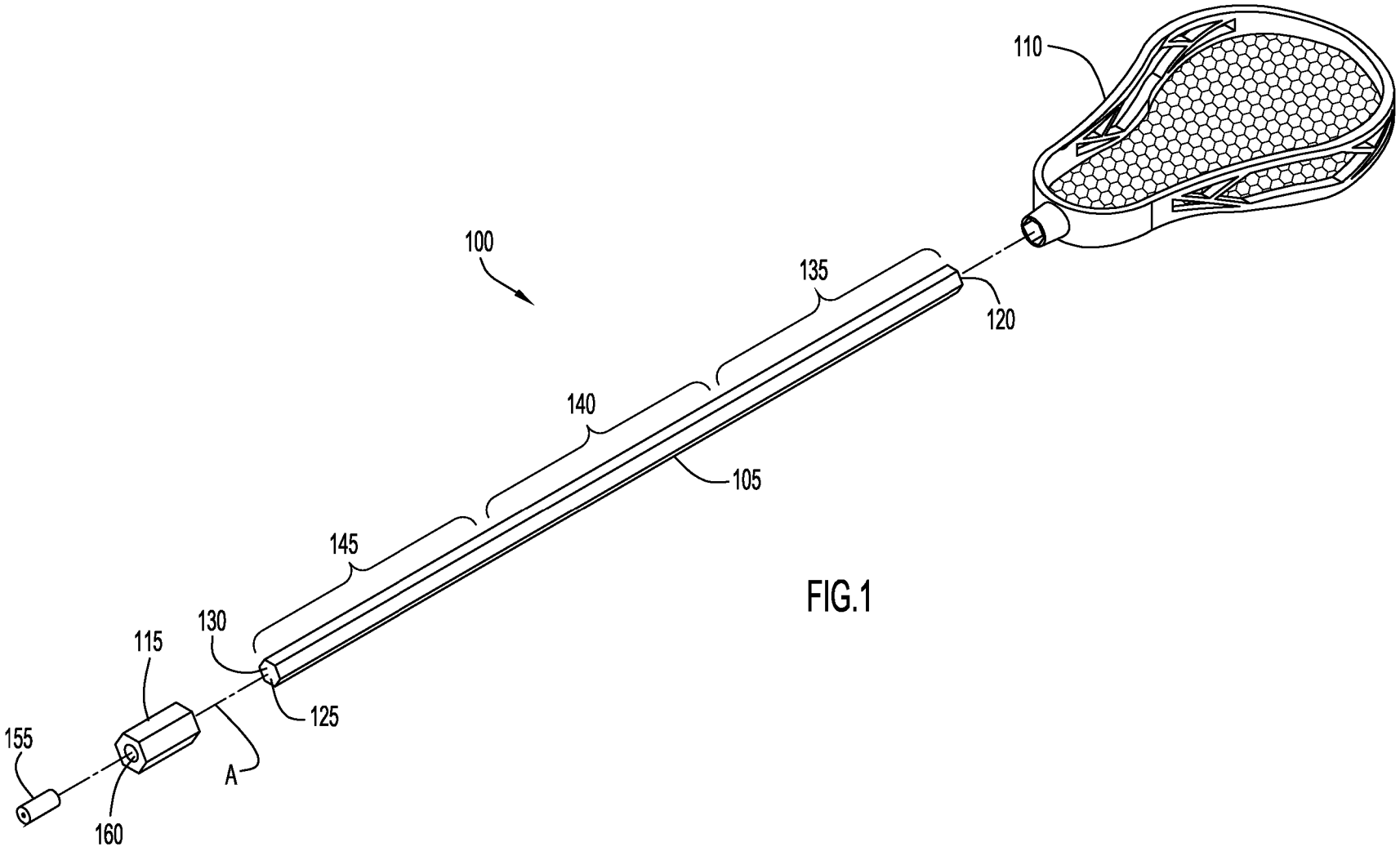
FIG. 1 illustrates a perspective view of a lacrosse training stick in accordance with an embodiment of the invention.

FIG. 1 shows a lacrosse training stick in accordance with an embodiment of the invention. As shown, the lacrosse training stick 100 includes a handle or shaft portion 105, a head portion 110, and an end cap or stopper 115. The shaft 105 may be an elongated, hollow tubular member defining a longitudinal shaft axis A. The shaft 105 includes a first or head end 120 and a second or butt end 125. An interior channel 130 having predetermined cross-sectional dimensions extends through the length of the shaft 105. While the cross sectional dimensions of the shaft 105 are not particularly limited, the shaft 105 typically possesses a polygonal shape to aid in gripping of the shaft. The shaft 105 may include an upper or head section 135, a lower or base section 145 disposed proximate the butt end 120 of the shaft, and an intermediate section 140 located longitudinally between the upper section 135 and lower section 145.

Figure 2B:
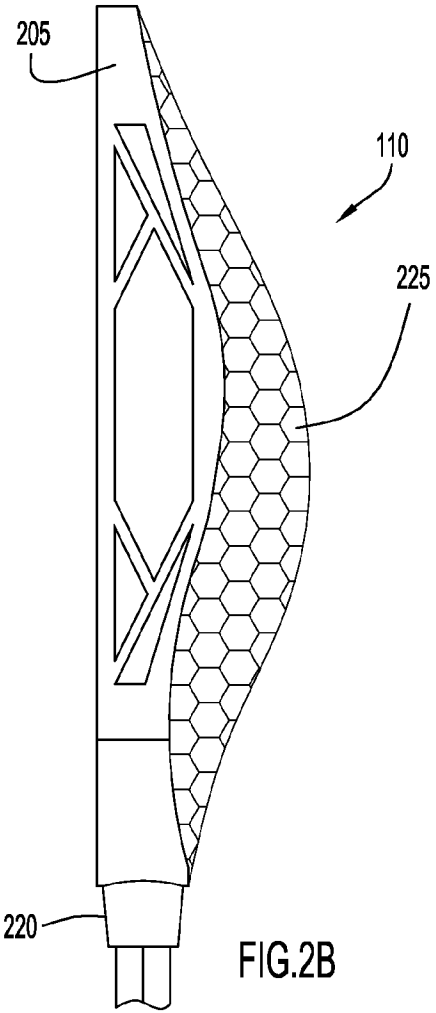
FIGS. 2A and 2B illustrate front and side close-up views, respectively, of the head portion of the lacrosse stick illustrated in FIG. 1.
Figure 2A:
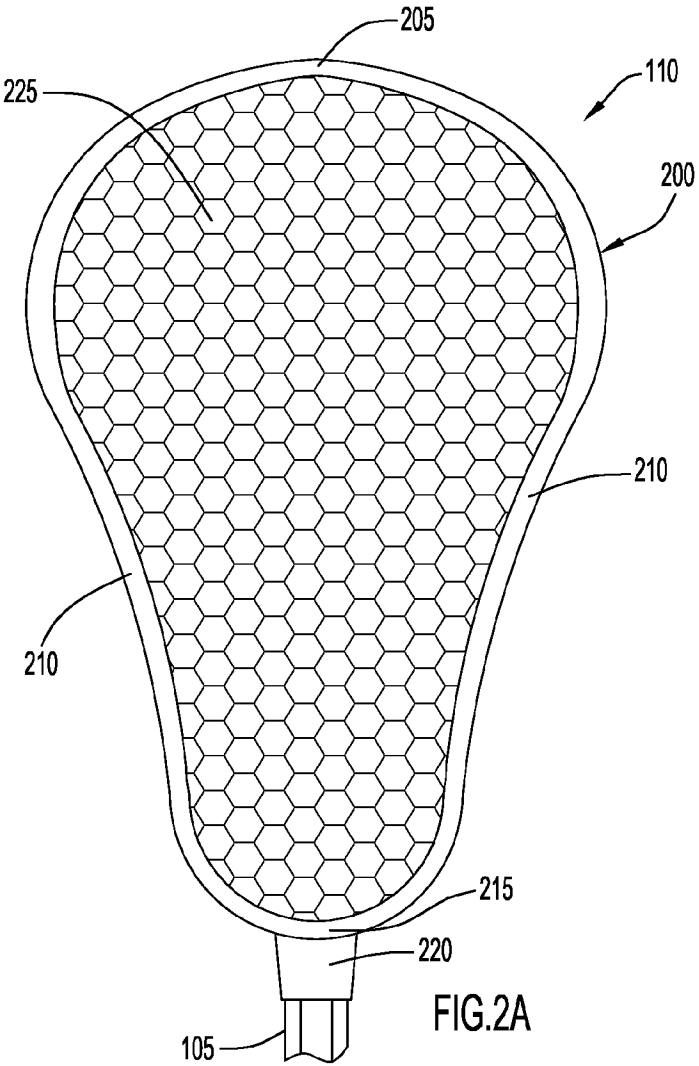

Referring to FIGS. 2A and 2B, the head portion 110 of the training stick 100 includes a contoured frame 200 having a predetermined shape operable to receive and propel a projectile such as a lacrosse ball. The frame 200 defines a top wall or scoop section 205 along is distal end that is configured to assist a user in picking up a projectile from a playing surface. The frame 200 further includes a pair of opposed side walls 210, a bottom wall 215, and a neck/throat 220. The frame 200 is typically a one-piece structure formed from, e.g., plastic. The head end 120 of the shaft 105 is coupled to the head portion 110, mating with a channel extending through the throat 220.

The head portion 110 further includes a pocket 225 operable to support a projectile such as a lacrosse ball. By way of example, the pocket 225 may formed of flexible webbing material (netting) secured to the frame (i.e., the scoop section 205, side wall sections 210, and bottom section 215). Alternatively, the pocket 225 may be formed of rigid material such as plastic contoured to form a cavity. With either configuration, the head portion 110 is configured to receive (catch), support (cradle), and propel (launch/shoot/pass) a projectile, as well as pick up a projectile from a playing surface.

Referring back to FIG. 1, the protective stopper or end cap 115 is coupled to the shaft 105, being disposed along the shaft butt end 125. The end cap 115 houses a light source 155 operable to generate a visible light beam (also called a light beam generator) that, in turn, forms a light point on a surface or target located remotely from the lacrosse training stick 100. Specifically, the end cap 115 includes a central cavity 160 that receives the light source 155. As a result, the light source 155 is embedded within the "eye" of the lacrosse training stick 100. The eye is located within the end cap 115, and is typically the point concentric with the shaft channel 130. That is, the eye is generally coaxial with the longitudinal axis A of the shaft 105 (i.e., it aligns with the shaft axis A).

The type of end cap 115 utilized is not particularly limited. By way of example, the end cap 115 may be a rubber stopper adapted to slide over and frictionally engage the butt end 125 of the shaft 105 while positioning the light source 155 and related components within shaft interior channel 130. By way of further example, the entire end cap 115 and light source 155 may be axially urged into the shaft interior channel 130.

The light source 155 may include, but is not limited to, a laser assembly including a barrel or housing that houses a laser diode and a collimating lens operable to form a beam having a predetermined cross section (e.g., a generally oval or generally circular cross-section). One end of the barrel includes a window that permits passage of the laser beam therethrough. With this configuration, the laser assembly emits a visible laser beam outward from the shaft butt end 125. The light source 155 may further include a power source and an actuator (e.g., a depressible switch) that controls voltage applied to the laser diode.

In operation, the light source 155 generates the light beam, directing it along the eye of the stick 105. In particular, the light beam is directed from the end of the shaft 105, along a pathway that is generally aligned with the shaft axis A (i.e., the light beam is generally coaxial with the shaft axis A). The light beam travels outward from the shaft 105, generating a point of light on a predetermined target located remotely from the lacrosse training stick 100 (e.g., a goal/net, another player, a wall, or a practice target). The placement of the point of light indicates a direct line of sight toward the target, along the stick axis A, from a single location on the stick 105 (i.e., the eye of the butt end 125).

In lacrosse, the ability to handle and control the lacrosse stick is important in becoming an effective player. Holding and directing the lacrosse stick is paramount to accurate throwing and shooting. The widely accepted manner for accurately throwing the ball begins with the player holding the lacrosse stick such that the upper and lower hands are generally even with the shoulders. For many maneuvers, one hand (e.g., the left hand) is placed within the base section 145 of the shaft 105 (e.g., just above the butt end 125), while the other hand is spaced 12-18 inches above the lower hand, within the intermediate section 140 of the shaft. With this configuration, the bottom hand acts a fulcrum and the upper hand provides leverage force or torque for propelling the ball when passing or shooting. This orients the shaft 105 such that it is generally horizontal, being positioned generally parallel to the playing surface (e.g., the ground). In addition, the butt end 125 of the shaft 105 faces the desired target, while the head portion 110 faces upward (i.e. the open face of the pocket 225 supporting the lacrosse ball faces upward).

To propel or hurl the lacrosse ball, the player pulls down on the base section 145 of the shaft 105 utilizing the lower hand (the hand oriented proximate the butt end 125) and pushing with the upper hand (the hand located within the intermediate section 140 of the shaft). This moves the shaft 105 along an arc that is effective to propel the ball from the pocket 225 toward the selected target. This motion is similar to that made when throwing a baseball or a football. That is, the motion hurls the ball supported by the pocket 225 of the head portion 110. When the throwing motion is completed, the head portion 110 faces generally downward, and is positioned closer to the target than the butt end 125.

It is imperative that a player develop the above described mechanics for throwing/propelling a lacrosse ball and positioning the lacrosse stick before, during, and upon completion of the passing/propelling motion. When the proper throwing/propelling technique is utilized, a projectile will generally travel along a pathway defined by the direct line connecting the eye of the lacrosse stick and the selected target. Consequently, when proper technique is utilized, the projectile will travel along the pathway identified by the light beam as being the direct line to the target. The projectile travels until it contacts the area of the target illuminated/marked by the light point.

Figure 3C:
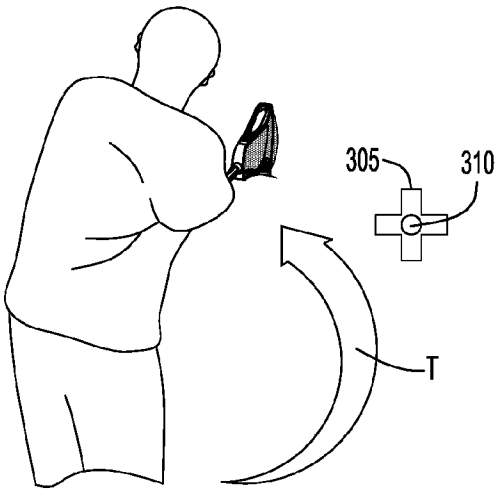
FIGS. 3A-3C are diagrammatic views illustrating the operation of the device of FIG. 1, showing the movement of the lacrosse training stick from a starting position to a final position.
Figure 3B:
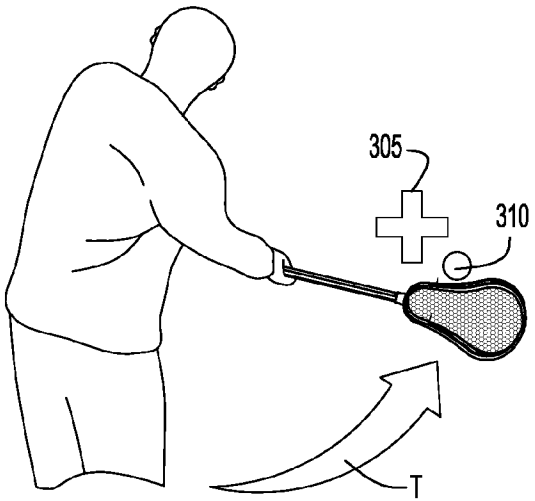
Figure 3A:
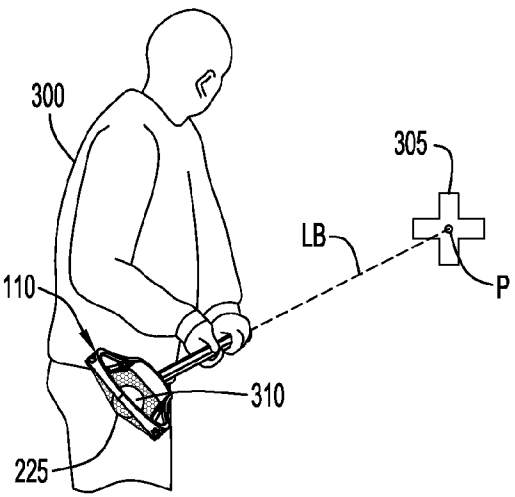

The operation of the training device is explained with reference to FIGS. 3A, 3B, and 3C. The player 300 initially selects/identifies a target 305 disposed at a predetermined location remote from the player. The player 300 orients the lacrosse training stick 100 in a first or starting position in preparation for propelling the lacrosse ball 310. For example, the player 300 may utilize a classic throwing/shooting position, in which the stick 100 is oriented generally horizontally and the butt end 125 of the shaft 105 is oriented closer to the target 305 than the head portion 110 (FIG. 3A). The lacrosse ball 310 rests within the pocket 225 of the head portion 110. The light source 155 is activated, generating a visible beam of visible light LB. The player 300 directs the light beam LB toward the selected target 305. The light beam LB forms a light beam point P on the target 305, indicating that the axis A of the shaft 105 is aligned with the target. In other words, once the light beam LB contacts the target 305, it indicates to the player 300 that the eye of the stick is aligned with the target.

Once the target 305 is identified and the light beam LB aligned therewith, the player 300 begins the throwing/propelling motion as described above. That is, the training stick 100 is rotated such that the base section 145 of the shaft 105 is pulled downward while the head portion 110 is driven or whipped forward (indicated by arrow T). This hurling motion propels the ball 310 from the pocket 225 (FIG. 3B). When the proper throwing technique is utilized, the ball 310 will travel forward, toward the target 305. For example, with proper technique, the ball may travel generally along the pathway that was previously identified/marked by the light beam LB. The ball 310 will continue to travel until it contacts the target 305. That is, if the player's aiming/passing/shooting technique is proper, the lacrosse ball 310 will contact the target 305 in the general area that the light point P previously marked. Upon completion of the whipping motion, the lacrosse training stick 100 is oriented in a second or final position, in which the head portion 110 is oriented closer to the target 305 than the butt end 125 of the shaft 105 (FIG. 3C).

If the lacrosse ball 310 contacts the target 305, the user understands that the mechanics of aiming and propelling the lacrosse ball were executed properly. If the ball 310 does not hit the target 305, however, the player 300 understands that he/she must adjust his/her aiming and propelling mechanics until accurate throws/shots are achieved. With repetition, the player's muscle memory is developed, improving the player's shooting/throwing skills (the player's muscles are being trained to remember one's throwing/shooting path). With practice, the player 300 will be able to groom his/her swing.

Figure 4A:
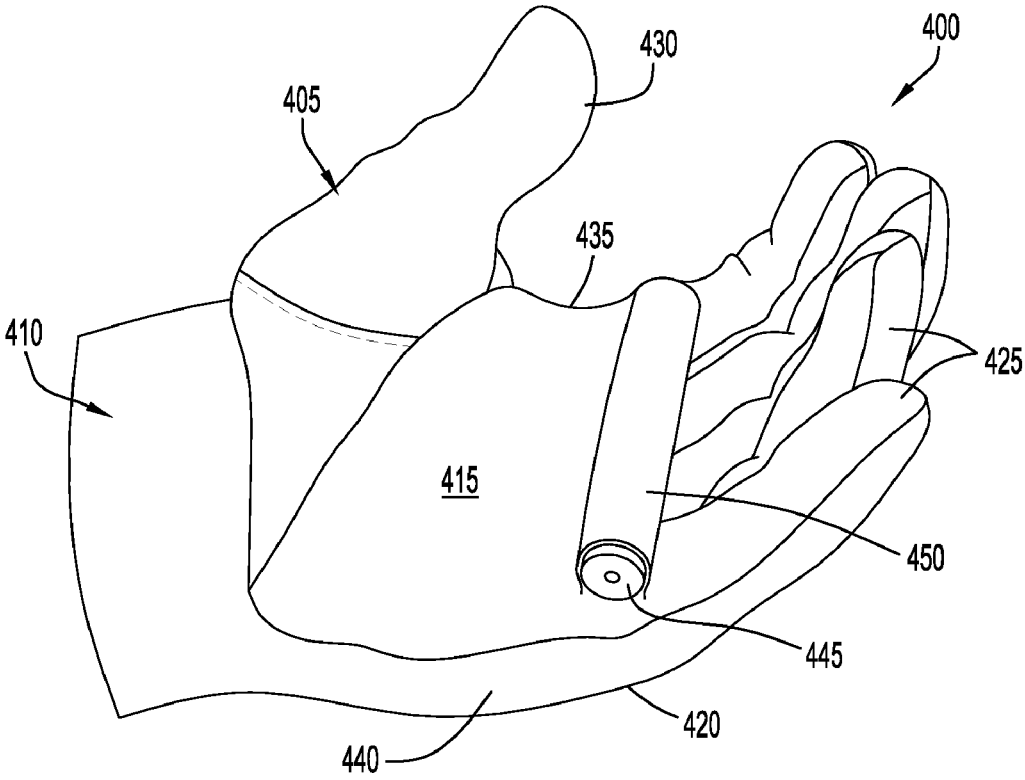
FIG. 4A illustrates a perspective view of a lacrosse training glove in accordance with an embodiment of the invention.
Figure 4B:
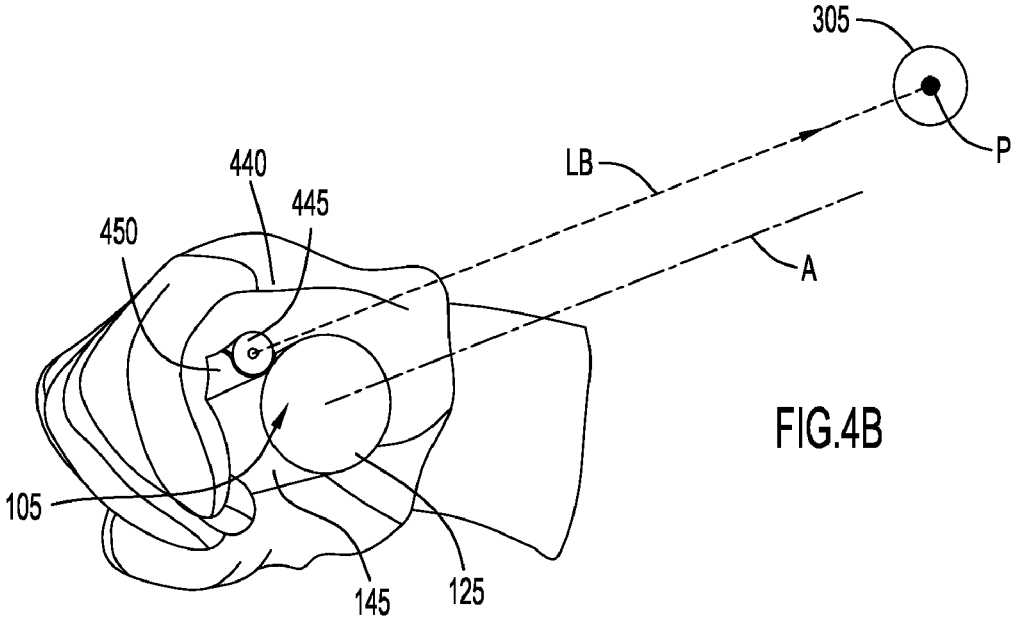
FIG. 4B is a perspective view illustrating the lacrosse training glove of FIG. 4A grasping the base section of a lacrosse stick.

In another embodiment of the invention, the lacrosse training device may include a lacrosse glove having an integrated light source. FIGS. 4A and 4B show a training glove 400 in accordance with an embodiment of the invention. As illustrated, the training glove 400 includes a hand portion 405 and a wrist portion 410. The hand portion 405 includes a palmar side 415, a dorsal side 420, a plurality of fingers 425, and a thumb 430, as well as a thumb sidewall 435 (oriented between the dorsal side 420 and palmar side 425, proximate the thumb) and a pinky sidewall 440 (similarly oriented between the dorsal and palmar sides, proximate the pinky finger).

In addition, the glove 400 includes an attached or integrated light source 445 adapted to generate a light beam LB toward a target. Specifically, the glove includes a chamber 450 formed into the palmar side 415 of the glove and oriented such that the light beam LB emanates from the pinky sidewall 440 of the glove, proximate the knuckles. The light source 445 is positioned within the glove such that, when the shaft 105 of the lacrosse stick 100 is grasped properly, the light beam LB is oriented generally parallel to the axis A of the shaft 105. The chamber may be formed of material similar to that utilized in forming the glove.

Figure 5C:
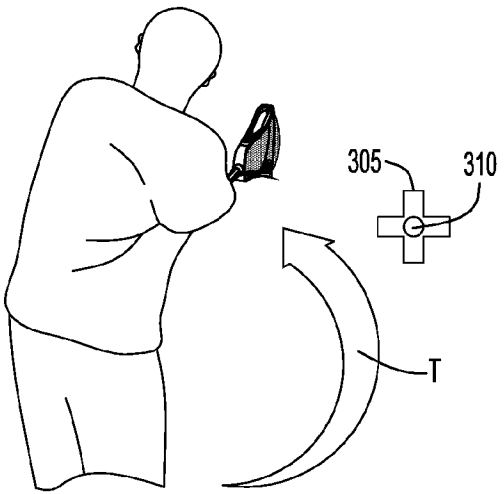
FIGS. 5A-5C are diagrammatic views illustrating the operation of the device of FIG. 4A, showing the identification of a target and moving the lacrosse stick from a starting position to a final position.
Figure 5B:
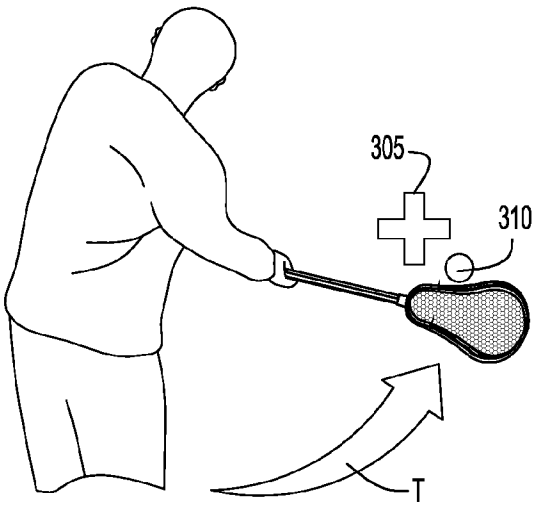
Figure 5A:
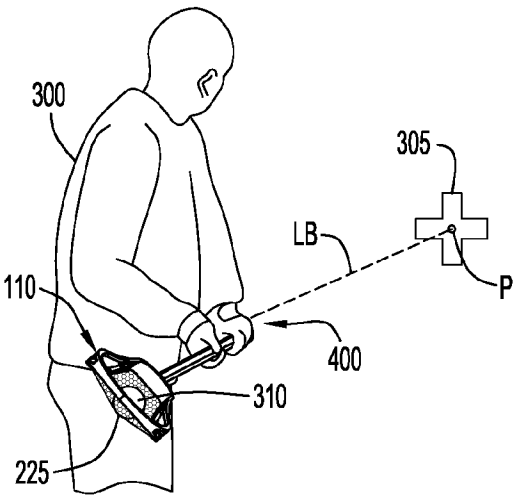

The operation of the training glove 400 is explained with reference to FIGS. 5A-5C. The player 300 begins in a classic throwing position, with the shaft 105 of the lacrosse stick 100 oriented generally parallel to the playing surface (i.e., the stick 100 is oriented generally horizontally). The light source 445 is embedded in the glove 400 that is utilized to grasp the base section 145 of the shaft 105 (the portion proximate the butt end 125). As noted above, in this position, the light source 445 is positioned such that the light beam LB is generally parallel to the axis A of the shaft 105 (i.e., the beam axis is parallel to, but offset from the shaft axis). As with the above embodiment, the light source 445 projects the light beam LB outward from the glove 400. The player 300 directs the light beam LB toward the selected target 305, generating a visible light point P thereon. The player 300 then initiates the shooting/passing motion as described above, propelling the lacrosse ball 310 toward the target 305. For example, when the proper aiming/shooting technique is utilized, the lacrosse ball will contact the target 305 in the general area previously marked by the visible light point P. In this manner, the glove 400 effectively tracks the movement of the shaft eye, moving in tandem therewith.

The target 305 utilized is not particularly limited. The target 305 may include a goal, a wall, another lacrosse stick, etc. The target 305, moreover, may be a generally planar structure adapted to couple to various structures and surfaces. The lacrosse stick 100 and target 305 may be utilized in a system for training a player in propelling a lacrosse ball 310. In one embodiment of the system, different colored targets would be provided that are configured to reflect different colored beams of light in various intensities when used outdoors in the daytime and/or indoors. Similarly, a system including the lacrosse glove and one or more targets 305 may be provided in a lacrosse training system.

Figure 6:
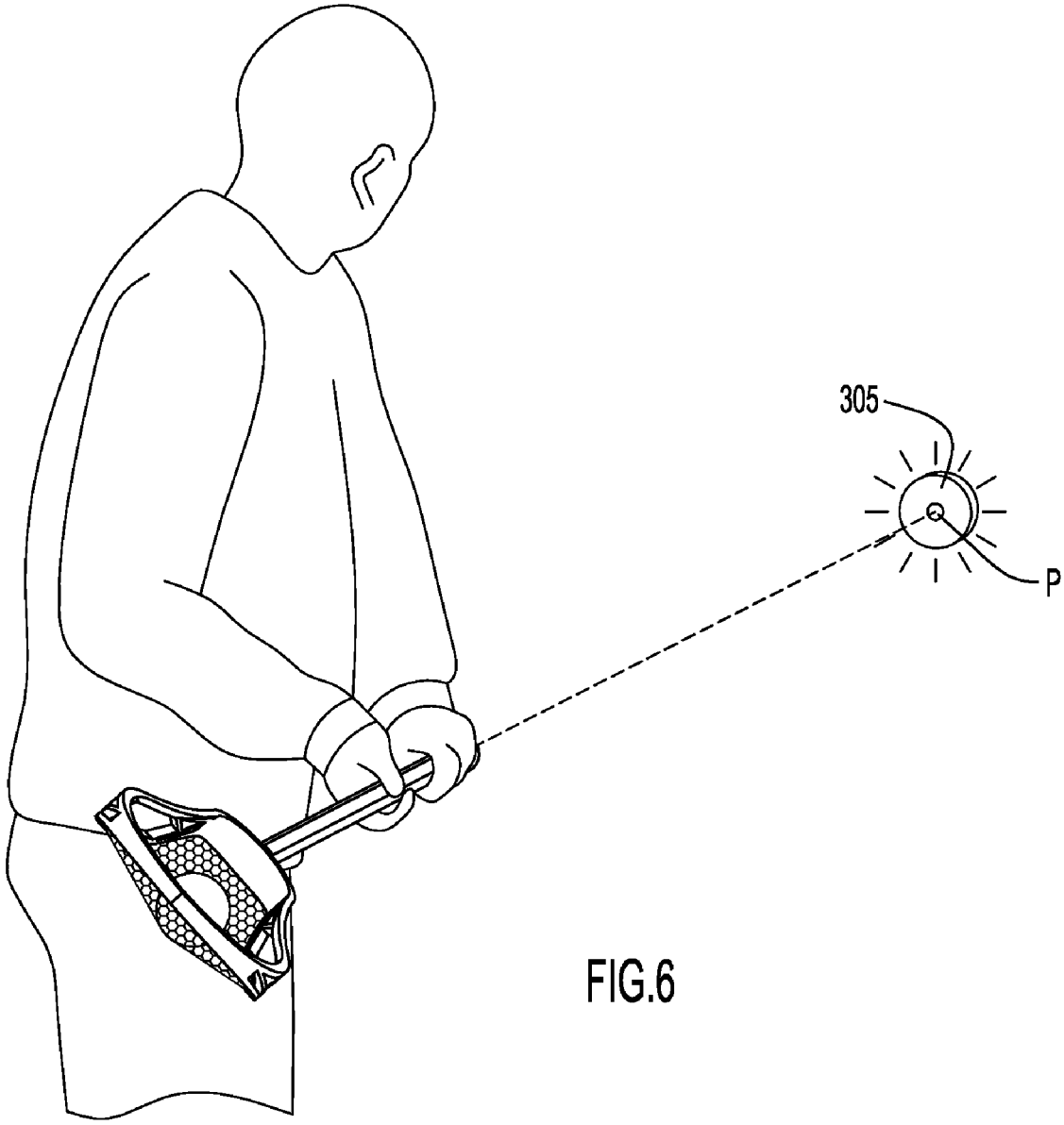
FIG. 6 diagrammatically illustrates a system including the lacrosse training stick of FIG. 1 and a target that generates a response when contacted by a light beam.

The target 305, moreover, may be configured to be responsive to the light beam LB, i.e., to activate, generating output that indicates to the player 300 when the light beam LB contacts the target 305. By way of example, the target 305 may be formed of reflective material that reflects the light beam LB to produce a reflected light burst back to the player 300. By way of further example, as shown in FIG. 6, the target 305 may include a sensor (e.g., a photosensor) embedded therein that, when contacted by the light beam LB, produces a visual or audio output (e.g., the target 305 may illuminate when contacted by the light beam) to indicate that the eye of the stick 100 is properly aligned with the target 305.

The activation of the target 305 serves the purpose of prompting the thrower to react and pull on the handle of the scoop or stick, and/or to notify the receiving individual (catcher) that the beam of light is on target. Using light beams LB will improve shooting accuracy by providing instantaneous, specific, and prescriptive visual feedback to the player 300 and the player will therefore be able to self-correct his/her aiming/pointing/steering of the implement eyebeam, thus activating and improving muscle memory for the skill.

The lacrosse training stick may further be modified to permit the training of throws/passes from starting points other than where the stick begins generally horizontal to the playing surface. Some lacrosse shooters will hold their stick at a slight angle, with the head portion 110 oriented higher than the butt end 125 of the shaft 105. Thus, in the first, starting position of the passing cycle, the lacrosse stick is not oriented horizontally with respect to the playing surface. Under such circumstances, the light source 155, 445 that generates the light beam LB which is coaxial with the shaft 105 would direct the light beam toward the playing surface, and not the intended target.

Figure 7:
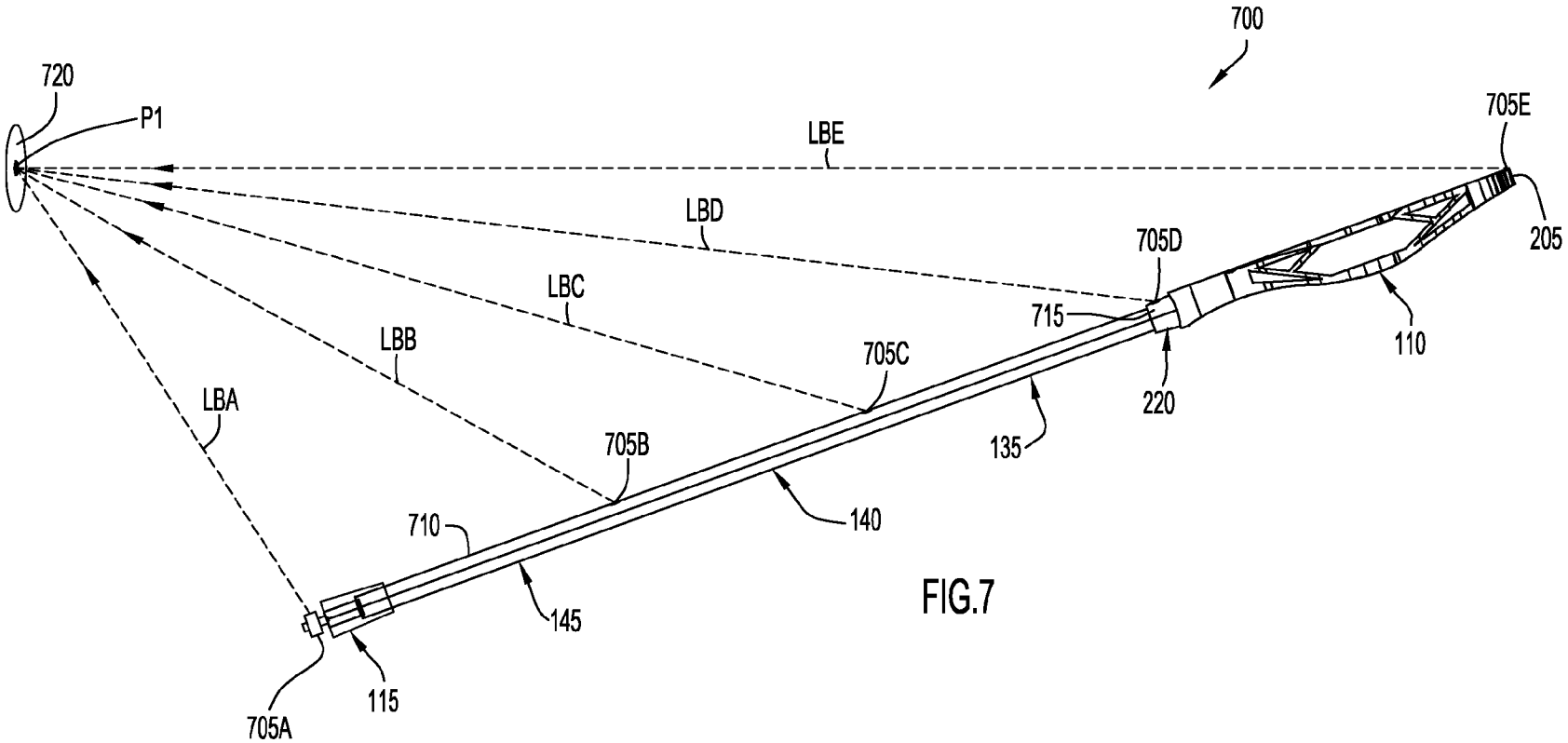
FIG. 7 diagrammatically illustrates a perspective view of a lacrosse stick in accordance with another embodiment of the invention.

In light of this, the lacrosse training stick may include a repositionable light source operable to direct light beams LB toward a target when the starting stick position is offset from horizontal. FIG. 7 illustrates a lacrosse training stick 700 in accordance with another embodiment of the invention. The training stick 700 includes a plurality of light sources 705A, 705B, 705C, 705D, 705E disposed at spaced predetermined locations along the stick. For example, a first light source 705A may be disposed within end cap 115. Instead of being fixed coaxial to the shaft axis A, however, the light source 705A may be pivotally coupled to the end cap 115 such that it is pivotally adjustable about an axis orthogonal to the shaft axis A. This permits the first light source 705A to direct a first light beam LBA in a direction that is not coaxial or parallel to the shaft axis.

In addition, a second light source 705B (generating second light beam LBB) may be embedded in the front face 710 of the shaft 105, being disposed in the shaft base section 145. Similarly, a third light source 705C (generating third light beam LBC) may be embedded into the front face 710 of the shaft 105 along the shaft intermediate section 140. Alternatively or in addition, a fourth light source 705D (generating fourth light beam LBD) may be embedded in the throat 220 of the head portion 110, and a fifth light source 705E (generating fifth light beam LBE) may be embedded into the scoop 205 of head section 110.

With this configuration, each of the aforementioned light sources 705A-705E may be selectively reoriented with respect to the shaft 105. This, in turn, selectively reorients the direction of the corresponding light beam LBA-LBE. As such, the light beam LBA-LBE may be directed along an axis that is neither horizontal nor parallel to the axis A of the shaft 105. In operation, the beam angle is set to the shooter's preference to facilitate the learning of the personal point-of-release for one's lacrosse pass or shot (i.e., the angle of the light beams LBA-LBE are set based on the players individual first or starting position for passing or throwing the ball). The player 300 then executes the shot, propelling the ball toward the target 720.

This teaching methodology uses a beam of light aimed to a target 720 for the purpose of teaching and assisting the player 300 to anticipate the exact point of release necessary in order to accurately execute a shot or pass, based upon their personal preference of their desired shooting angle. This, in turn, promotes developing the skill of anticipating the proper point of release, while building muscle memory for the anticipation and execution of a more timely and accurate shot and/or pass.

Thus, one or more light sources 705A-705E may be disposed on the shaft 105, with each light source being selectively angled to provide for an adjustable beam direction out and up from any point along the shaft. In this manner, the lacrosse training stick 700 is customized, being set to the shooter's personal preference to facilitate the learning of the personal point-of-release for a lacrosse pass or shot. This teaching methodology uses points along the shaft to project a beam (or multiple converging beams), to a target 720 for the purpose of teaching and assisting the user to anticipate the exact point of release that is needed in order to accurately execute a shot or pass based upon the personal preference of the player's desired shooting angle.

Each of the light sources 705A-705E may be utilized individually or collectively. When utilized collectively, the beams of light LBA-LBE can be coordinated and directed from any one or more points located on, around or within any part of the lacrosse training stick 700 (the shaft portion 105, the head portion 110, or the end cap 115). Further, when a plurality of light sources 705A-705E are disposed on the lacrosse stick 700, the light beams 705A-705E can be coordinated in such a way that they converge to a point P1 on the target 720 for the purpose of teaching and assisting the user to anticipate the exact point of release that is needed, in order to accurately execute his/her shot or pass based upon the personal preference of their desired shooting angle. The light sources 705A-705E can be integral with the head portion 110 or can be a stand alone device added after market.

Figure 8:
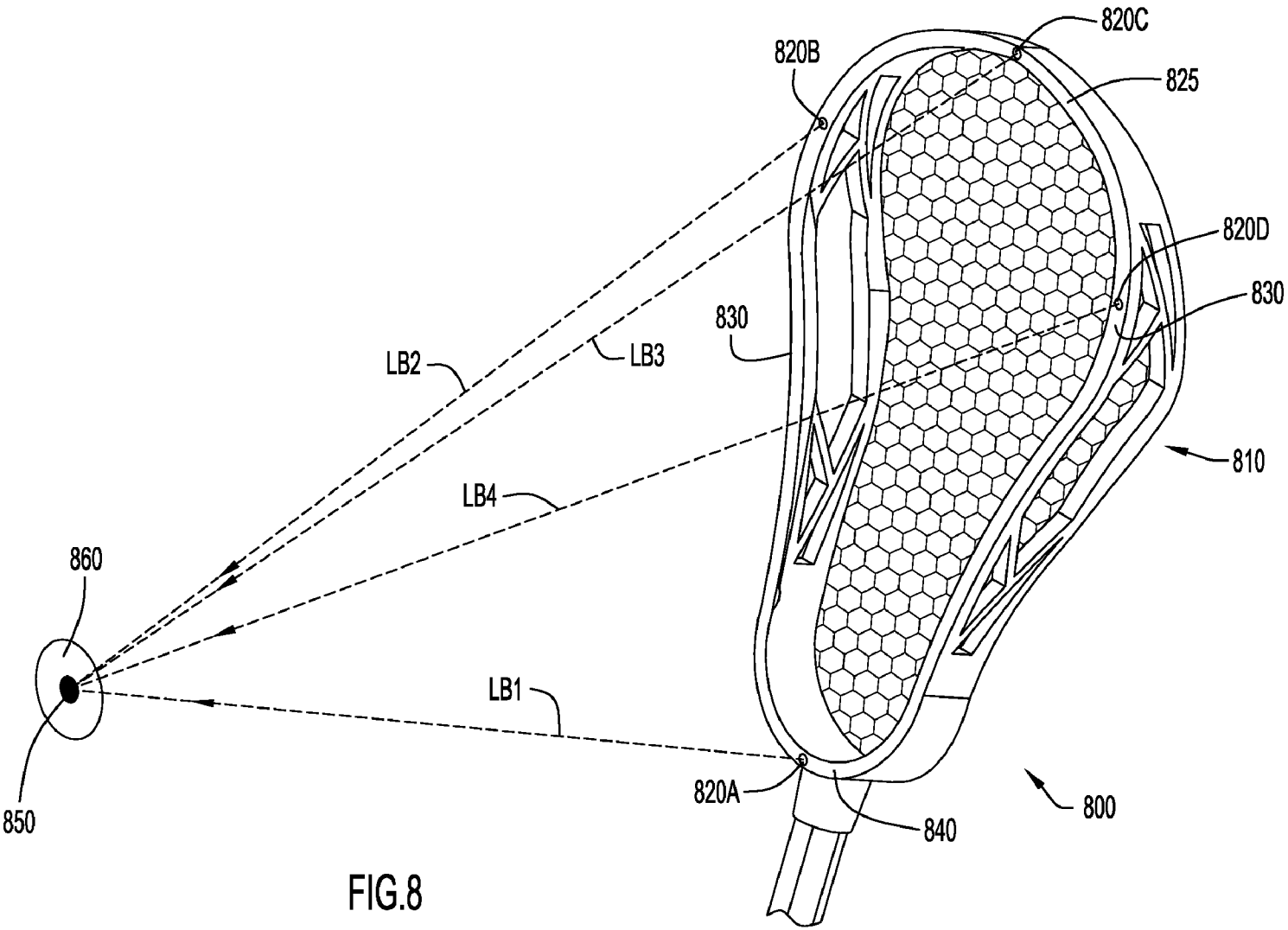
FIG. 8 illustrates a perspective view of a lacrosse stick head portion in accordance with another embodiment of the invention.

FIG. 8 illustrates a lacrosse training device in accordance with another embodiment of the invention. As illustrated, the head portion 810 of the stick 800 may include a plurality of light sources 820A, 820B, 820C, 820D disposed at predetermined locations along the frame such that a series of coordinating light beams LB1, LB2, LB3, LB4 (respectively) are directed from around the perimeter of the head portion 810. For example, a light source may be located within the scoop section 825, in each side wall 830, and in the bottom wall 840. The light sources 820A-820D may be designed to converge together to focus at a point 850 on the target 860. As with the above embodiment, the focal point 850 is adjustable by adjusting the direction of each light beam LB1, LB2, LB3, LB4 to compensate for shots initiating at varying distances from the target, as well as various stick orientation points. This refocusing as a function of distance from the target is typically performed manually by redirecting each beam to impact the target at the same point. As an alternative, the unit can be provided with an automatic range detector that utilizes the detected range to adjust the beam angle. Range detectors of this type utilize electromagnetic or infrared energy to detect range and are found in a variety of devices such as cameras having automatic focusing capabilities.

Thus, the present invention provides a system and method for training a user in accurately propelling a lacrosse ball toward a selected target. The method takes advantage of the fact that the direction in which the bottom of the shaft (i.e., the butt end 125) is pointing, steers/drives the point of release, which, in turn, is precisely the direction in which ball will travel. That is, during the shot (i.e., the pulling of and the driving of the bottom of the shaft 105 combined with the top-hand follow through directing the shot toward the target), it is the direction of the butt end 125 at the time of release that dictates the direction in which the ball must travel. The phrase "eye of the stick" describes the bottom-most part of the handle located at the base of the implement, and wherever the "eye" is looking and being directed, by the bottom hand, is where the ball will travel. It is the driving of the butt end of the stick forward (the eye) with the lower hand driving forward on the shaft, in combination with a forceful pulling down on the bottom of the shaft, with that same bottom hand, that gives power combined with accuracy to the shot. A player focusing on where the eye (the bottom of the base end) is pointing, and/or steering the eye of the stick with the bottom hand, (at the moment of pulling down on the shaft) is the player that combines power with accuracy.

The present invention solves several common lacrosse problems. First, this invention will promotes a "steadying of the hands," while shooting because at first use the beam of light will be moving around the target quite a bit. The user can react to the movement with a "softening" and/or steadying of the hands, thus quieting and minimizing the dancing movement of the beam on the target. This use of a beam of light for improved gripping of the shaft can be applied in conjunction with another stick head catching the ball, i.e., with a "recognition" of the beam of light. The steadying of the hands solves a significant problem when shooting with a lacrosse stick or scooping for accuracy (which is the excessive movement of the implement handle due to improper technique and lack of muscle memory). This invention gives lacrosse users a new method of vastly improving gripping of the shaft, cross-control and muscle memory in order to more accurately aim and direct their throws, passes, and shots, much more precisely. By directing/steering the beam of light onto a precise location, users of the device can train their muscles, thus improving their grip in order to steady the implement and more accurately steer their shots, throws and passes to that exact, desired, location and be able to "self or auto-correct" their shooting/passing/throwing experience, before the release of the ball, in a manner consistent with improving muscle memory. An important distinction to note is that a user will receive auto-feedback during shot/pass preparation, before the throw is released, as opposed to having to wait to see where the ball ends up.

This above described system also improves cradling control of the cross and scoop. A user can cradle the ball in the pocket and observe the movement of the projected beam of light on the ground or wall. The unique problem solved here is the reduction of excessive arm swinging and more efficient gripping while cradling. A tight cradle and reduced arm swinging while cradling is more efficient and requires greater muscle memory in order to control the implement handle/shaft during the cradling motion. Excessive arm swinging moves the ball around in the pocket too much, the implications of which can be bouncing the ball out of the pocket inadvertently, and not having the ball "nest" properly in the pocket before shooting. Users of this invention can work on their tight, muscle-memory, cradling skills while watching the eye beam of light on any surface, including a "target training surface" of some type with much greater instantaneous, specific, and prescriptive feedback to the user, and the user therefore is able to "self-correct" the cradling in a manner consistent with improving muscle memory.

Figure 9:
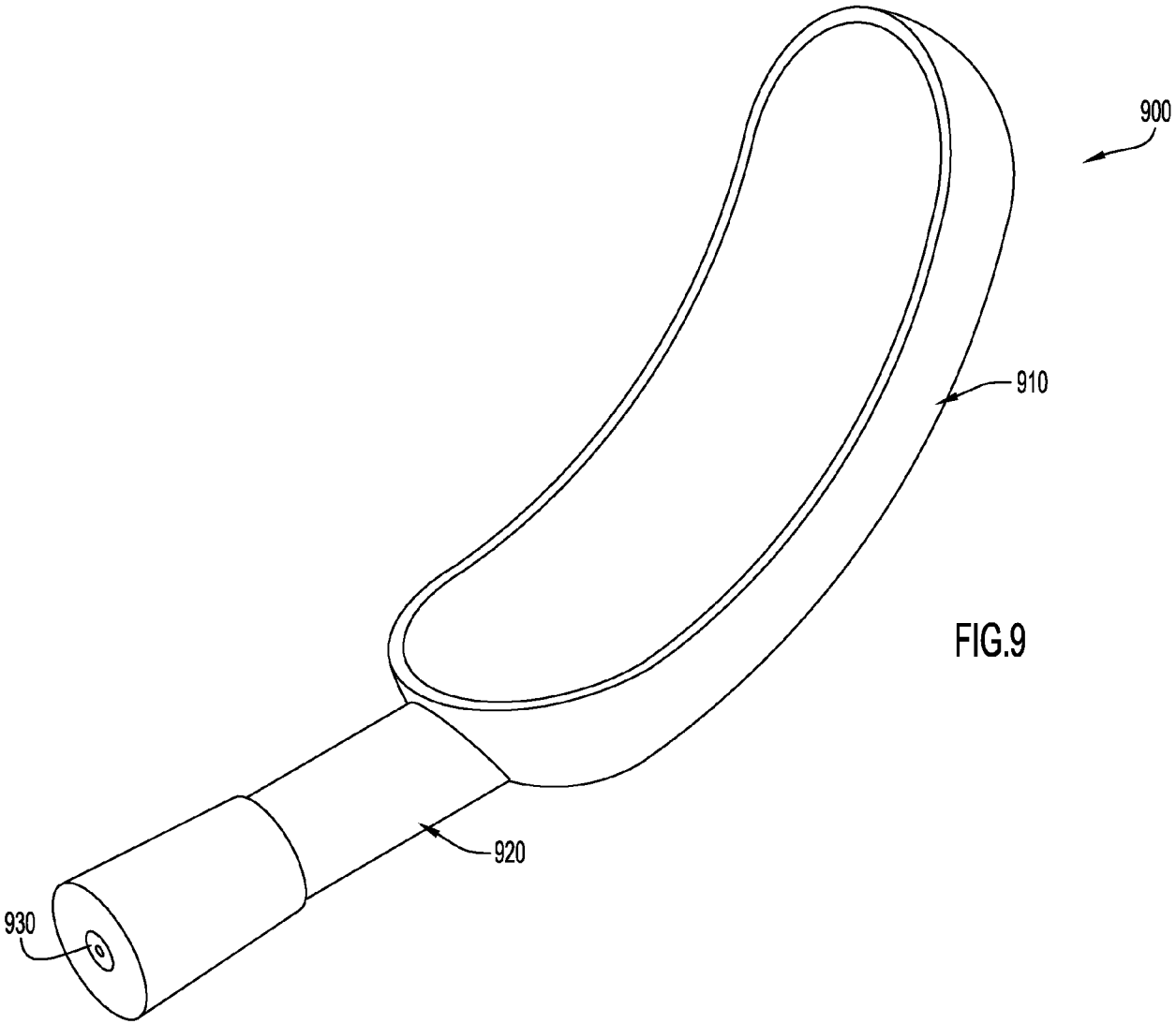
FIG. 9 illustrates a perspective view of a projectile launcher in accordance with another embodiment of the invention.
Figure 10:
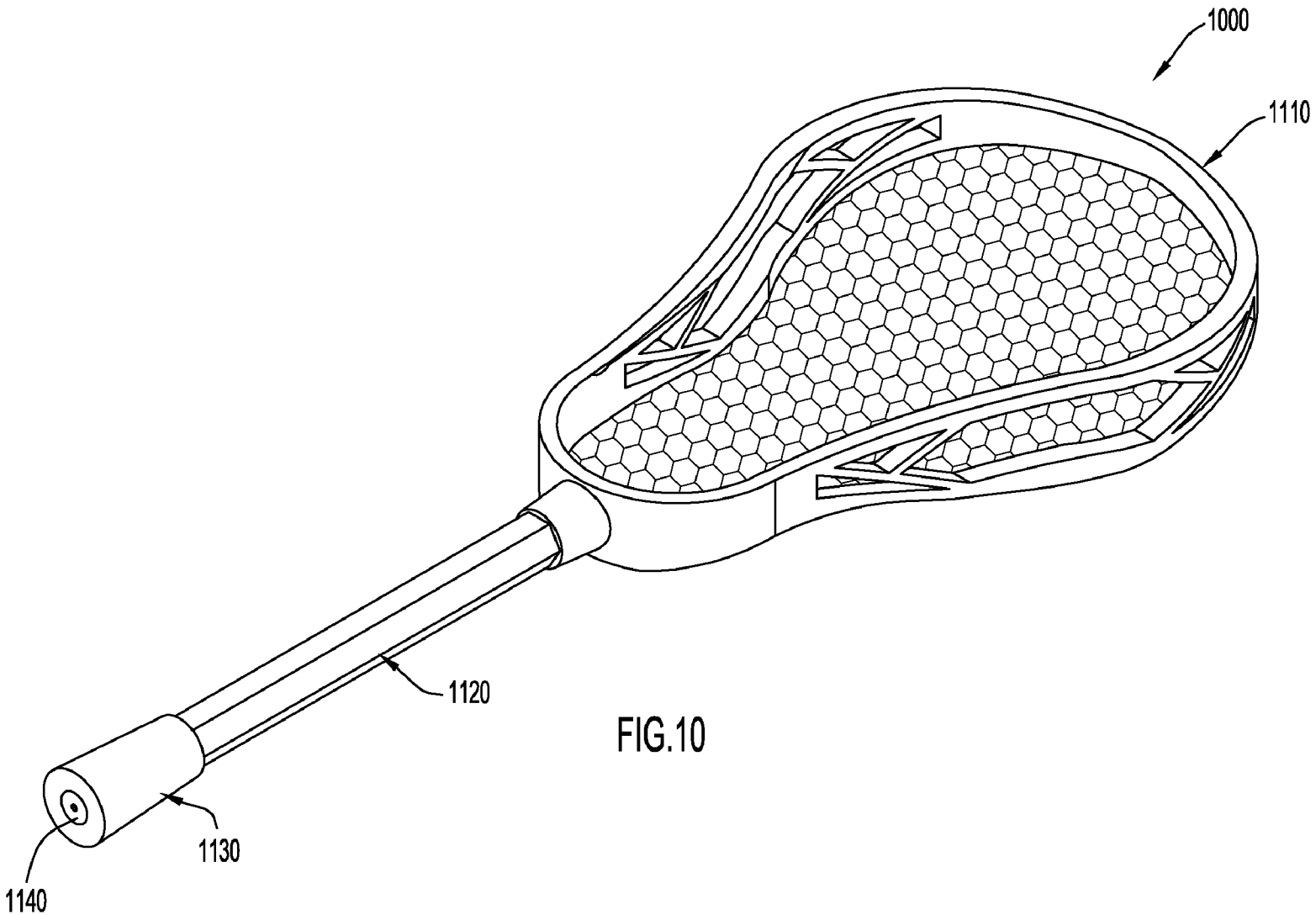
FIG. 10 illustrates a perspective view of a lacrosse stick having a truncated shaft.

The present invention also has applicability for use within any catapulting type of device (e.g., a toy or other device). By way of example, the inventive technique and system may be utilized in toy scoops. Referring to FIG. 9, a scoop 900 is shown (e.g., a Jai alai basket) including a head portion 910 formed of substantially rigid material (e.g., plastic), and a shaft 920 including a light source 930 operable to generate a visible light beam. By way of further example, the inventive system and technique may be utilized with non-regulation lacrosse sticks (including toy lacrosse sticks). FIG. 10 shows a non-regulation lacrosse stick 1000 with a head portion 1110 and a truncated shaft 1120 and an end cap 1130. The end cap 1130 includes a light source 1140 operable to generate a visible light beam. These one-handed devices utilize a propelling/throwing technique similar to that of a two-handed device. Briefly, in the starting position, the base of the shaft points towards the desired target. The player utilizes the snap rotation created by the hand situated near the butt end of the shaft. Thus, when proper technique is used, the ball will travel along the beam of light initially directed toward the target.

In addition the shaft portion, head portion, and end cap forming the lacrosse training stick may possess any suitable dimensions and may be formed of any suitable materials. For example, the shaft 105 may be fabricated from a material such as carbon fiber composite material, titanium, or aluminum, plastic, etc. The head portion 110 may be any size and shape and possess any suitable dimensions. The head portion 110 includes any offset, non-offset, and canted head portions. That is, wile a non-offset head portion is illustrated, the present invention lacrosse sticks having an offset head may also be utilized. With an offset head portion 110, the front of the head appears curved when viewed from the side. For example, a full-offset head includes a higher degree of curvature than a mid-offset head. The full offset is designed to maximize control and feel, whereas non-offset (no curve) or mid-offset heads are recommended for beginners for learning how to throw properly. In addition, head portions that are canted with respect to the shaft may be utilized. Generally, a forward cant allows the ball to sit higher in the pocket so players can release the ball quicker.

The system may also include glasses that eliminate the risk for eye injury due to certain types of beams of light, if needed. For example, red glasses would minimize the risk of using an infrared beam, but another, weaker beam of light (such as one used for a mini-lacrosse toy or educational scoop) might not need protective glasses.

While a visible light beam is indicated, the system may further include an invisible light beam that is detected by a target. For example, the lacrosse training stick may generate a light beam that falls outside the visible spectrum (e.g., an infrared (IR) beam). The beam may be sensed by a target in which an appropriate sensor is disposed. Thus, when contacted by the invisible beam, the target may produce sensory output to indicate to a player that the stick is properly aligned with the target.

The present system can be utilized to teach a variety of lacrosse movements, including, but not limited to, throws (or releases) from a variety of angles such as side arm, underhand (crank shot), overhand, and ¼ arm, as well as releases which do not possess full follow-through, such as when a player "pops" the ball out of the stick with an "abbreviated follow-through motion." Experienced players refer to this as "popping the ball out of the stick," which stops short of a full arm extension of the top arm.

While a light line generator is illustrated as being embedded within the end cap, shaft, or head portion, the training device of the present invention may be produced as an after-market device in which a coupling device housing the light source connects to the lacrosse stick. By way of example, the coupling device may be a generally rigid sleeve housing the light source and connectable to the lacrosse shaft or head portions. By way of further example, the coupling device may be generally flexible sleeve (e.g., an elastic, silicone, or rubber sleeve) including the light source that is easily manipulated onto the lacrosse stick (e.g., onto the shaft, end cap, etc). The coupling device may further be in the form of a strap having fasteners that selectively connect the light source to any area of a lacrosse stick (e.g., by wrapping around the shaft, with the ends being connected together using fasteners (hook and loop fasteners, hooks, snaps, etc.)).

It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration. Thus, it is intended that the present invention covers the modifications and variations of this invention provided they come within the scope of the appended claims and their equivalents.

I claim:

1. A lacrosse training stick for teaching aiming and propelling of a lacrosse ball, the lacrosse training stick comprising:

a shaft portion comprising an elongated shaft having a first shaft end and a second shaft end opposite the first shaft end, the shaft defining a shaft longitudinal axis;

a head portion coupled to the first shaft end, the head portion comprising a frame including a scoop section, a pair of opposed side walls, and a bottom wall, and material suspended from the frame to form a pocket operable to receive and support a lacrosse ball; and a light source pivotally coupled to the second end of the shaft such that the light source is positioned along the shaft longitudinal axis, wherein:

the light source generates a beam of visible light that forms a visible light point on a surface remote from the lacrosse stick, and the pivotal coupling enables selective reorientation of the light source with respect to the shaft such that the light beam is transmitted in a plurality of directions, wherein at least one of said plurality of directions is generally coaxial with the shaft longitudinal axis, wherein the lacrosse stick is configured to propel the lacrosse ball supported by the pocket toward the remote surface.

2. The lacrosse training stick of claim 1, wherein the material forming the pocket comprises flexible webbing.

3. The lacrosse stick of claim 1, wherein the light source comprises a laser barrel including a laser diode and a collimating lens.

4. The lacrosse training stick of claim 1, wherein the light source moves about a light source axis oriented generally orthogonal to the longitudinal shaft axis.

5. The lacrosse training stick of claim 1, wherein the lacrosse stick comprises a plurality of light sources, each configured to generate a beam of visible light that forms a light point on a surface remote from the lacrosse stick.

6. A method of training a user to propel a lacrosse ball utilizing the lacrosse training stick of claim 1, the method comprising:

orienting the lacrosse stick in a first position;

identifying a target located a predetermined distance from the lacrosse stick;

aligning the lacrosse stick with the target such that the light beam generated by the light is directed toward the target to mark the target with the light point; and repositioning the lacrosse stick from the first position to a second position by moving the lacrosse stick in a motion sufficient to propel the lacrosse ball from the head portion.

7. The method of claim 6 further comprising moving the lacrosse stick in a motion sufficient to launch the lacrosse ball toward the target marked by the light point.

8. The method of claim 6, wherein:

the shaft includes a head section located proximate the first shaft end, a base section located proximate the second shaft end, and an intermediate section located between the base section and the head section; and the method further comprises:

placing a first hand within the base section of the shaft and placing a second hand within the intermediate section of the shaft, and pulling down on the base section of the shaft with the first hand to generate an arc motion sufficient to propel the ball toward the target.

9. The method of claim 6 further comprising pivoting the light source about the light source axis from a position in which the light beam in transmitted in a direction generally coaxial with the shaft longitudinal axis to a position in which the light beam is transmitted in a direction nonparallel to the shaft longitudinal axis.

10. The method of claim 6, wherein:

the light source moves about a light source axis oriented generally orthogonal to the longitudinal shaft axis; and the method further comprises pivoting the light source about the light source axis from a position in which the light beam in transmitted in a direction generally coaxial with the shaft longitudinal axis to a position in which the light beam is transmitted in a direction nonparallel to the shaft longitudinal axis.

11. A method of training a user to propel a lacrosse ball supported by a lacrosse stick, the method comprising:

(a) obtaining the lacrosse stick of claim 1;

(b) positioning a lacrosse ball within the pocket defined by the head portion;

(c) selecting a target located a predetermined distance from the lacrosse stick;

(d) orienting the lacrosse stick in a first lacrosse stick position such that the light point generated by the light source is projected onto the target, thereby identifying the target;

(e) propelling the lacrosse ball toward the identified target by reorienting the lacrosse stick from the first lacrosse stick position to a second lacrosse stick position, wherein, during repositioning, the lacrosse stick is moved in a motion sufficient to launch the lacrosse ball from the pocket defined by the head portion.

12. The method of claim 11, wherein:

the lacrosse stick further comprises a cap disposed at the second end of the shaft;

in the first lacrosse stick position, the end cap is oriented closer to the target than the head portion; and in the second lacrosse stick position, the head portion is oriented closer to the target than the end can.

13. The method of claim 11, wherein the target generates sensory output in response to being contacted by the visible light beam.

14. The method of claim 11, wherein:

the lacrosse stick comprises a plurality of light sources, each light source configured to generate a beam of visible light that forms a light point on a surface remote from the lacrosse stick; and the method further comprises directing at least one of the plurality of light beams toward the target.

15. The method of claim 11 further comprising pivoting the light source about the light source axis from a position in which the light beam in transmitted in a direction generally coaxial with the shaft longitudinal axis to a position in which the light beam is transmitted in a direction nonparallel to the shaft longitudinal axis.

16. The method of claim 11, wherein:

the light source moves about a light source axis oriented generally orthogonal to the longitudinal shaft axis; and the method further comprises pivoting the light source about the light source axis from a position in which the light beam in transmitted in a direction generally coaxial with the shaft longitudinal axis to a position in which the light beam is transmitted in a direction nonparallel to the shaft longitudinal axis.

* * * * *